United States Patent [19]

Collins

[11] 4,062,149

[45] Dec. 13, 1977

[54] PARKING SPACE BARRIER

[76] Inventor: Wesley A. Collins, 4039 Arey Drive, San Diego, Calif. 92154

[21] Appl. No.: 716,507

[22] Filed: Aug. 23, 1976

[51] Int. Cl.[2] ..... E01F 13/00

[52] U.S. Cl. ..... 49/49; 49/35

[58] Field of Search ..... 49/35, 49; 292/169, 292/DIG. 57

[56] References Cited

U.S. PATENT DOCUMENTS

| | | | |
|---|---|---|---|
| 2,535,275 | 12/1950 | Dixon | 292/169 X |
| 3,625,031 | 12/1971 | Alley | 70/DIG. 57 |

FOREIGN PATENT DOCUMENTS

| | | | |
|---|---|---|---|
| 1,401,359 | 4/1965 | France | 49/35 |

*Primary Examiner*—Kenneth Downey

*Attorney, Agent, or Firm*—Isbell & Charmasson

[57] ABSTRACT

A temporary barrier to selectively block a traffic lane, a driveway or the access to an enclosed parking space which comprises a vertical post inserted into a ground imbedded receptacle. Within the post a flexible locking lever can be released through a pinhole which may be obstructed by means of a padlock thus preventing the removal of the post.

3 Claims, 3 Drawing Figures

PARKING SPACE BARRIER

BACKGROUND OF THE INVENTION

It sometimes becomes necessary to place a temporary barrier to vehicular traffic across a road, lanes, or an entrance and exit driveway. This is commonly accomplished by installing light portable fixtures such as sawhorses or free standing sign posts. This type of obstacles, however, can be easily moved aside or knocked down by a trespasser. Furthermore, they are awkward to handle and cumbersome to store when not in use.

There has never been a simple and efficient way to secure an assigned parking area around a business establishment or a multi-unit residence in the absence of the owner's vehicle.

"Reserved," or "No Parking" signs, and other notices often remain unheeded by hurried drivers. The returning space owner is then left with the frustration of having to find another open parking slot.

Various attempts have been made in recent years to devise barriers for securing unenclosed parking spaces, two such devices are disclosed in U.S. Pat. No. 3,698,135 to Boots et. al. and U.S. Pat. No. 3,564,769 to Wilson et. al. The present invention is remarkable by its simplicity and efficient use of a limited number of components.

SUMMARY OF THE INVENTION

The present invention comprises a removable post erected in the surface of a parking space of traffic lane which can be keylocked into place. It provides an inexpensive and efficient means for temporarily closing the area to vehicular traffic. It also provides a barrier, sign or anchoring post which may be selectively removed.

IN THE DRAWING

DESCRIPTION OF THE PREFERRED EMBODIMENT OF THE INVENTION

Figure 1:
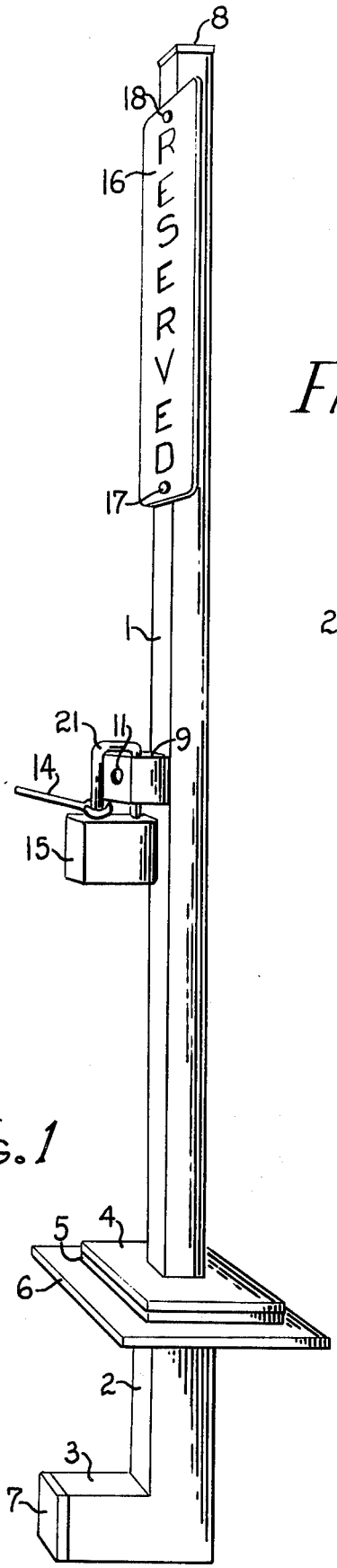
FIG. 1 is a perspective view of barrier inserted into its support.

Referring now to the drawing there is shown a L-shaped tubular receptacle 2, imbedded into the ground surface 20 of a driveway. The horizontal section 3 of the L-shaped receptacle is closed by a plug 7 and the upper end, surrounded by a flat flanged area 6, is flush with the ground surface 20.

A tubular post 1 having an outside diameter slightly smaller than the inside diameter of receptacle 2 has its lower part inserted in said receptacle 2. The upper end of the post 1 is closed by a plug 8. It's lower end is open and truncated in a 45° angle.

A flexible rod forming a lever 12 is fastened to the inside upper section of the post 1 by rivets 17 and 18.

The lower end of the lever 12 is bent horizontally to form a bolt 13 extending past the lower edge of the post 1 and past the lower edge of vertical section of the L-shaped receptacle, into its horizontal section 3. As long as the lever 12 is in its resting position, the bolt forming end 13 prevents the post 1 from being withdrawn out of the receptacle 2.

Figure 2:
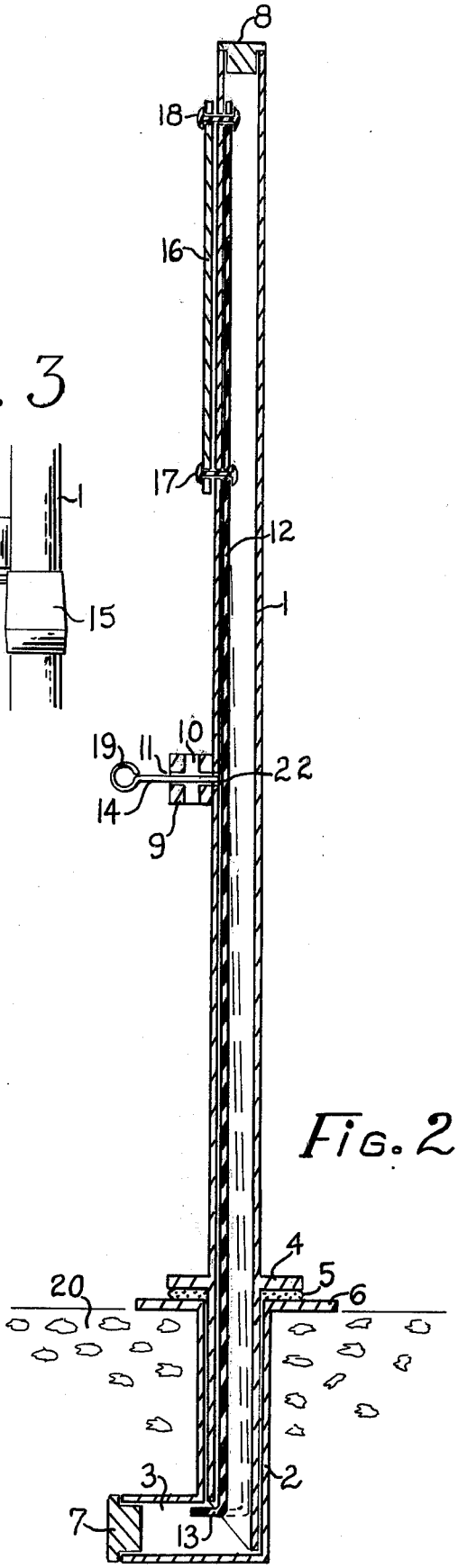
FIG. 2 is a side cross-sectional view of the barrier shown in FIG. 1 disclosing the locking mechanism.

The post 1 can only be released by pushing the lever 12 towards the center of the post 1 thus retracting the bolt forming end 13 into the post 1 as shown by broken lines in FIG. 2. This may be done with a pin 14 or any elongated tool inserted through a apperture 22 drilled in the middle section of post 1 on the side occupied by lever 2.

A metal block 9 is permanently secured against the post 1 over the apperture 22.

A horizontal channel 11 drilled through the block 9, in line with aperture 22, give access to the lever 12, channel 11 is intercepted by a vertical channel 10 drilled through the block 9. Channel 10 is designed to receive the locking loop 21 of a padlock 15. When the padlock 15 is locked through channel 10 access to the lever 12 through channel 11 and apperture 22 is obstructed and the post cannot be removed.

Pin 14 has a loop 19 at one end through which it can be secured to the padlock 15 for safekeeping as shown in FIG. 1.

Figure 3:
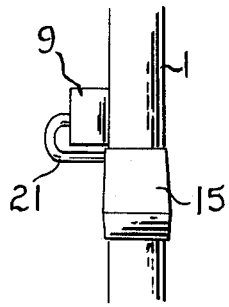
FIG. 3 is a detailed view of the locking mechanism illustrating the use of padlock as a release tool.

The open end of the padlock loop 21 could be used in place of the pin and inserted through channel 11 and apperture 22 to push back the lever 12, as shown in FIG. 3. A sign 16 is fastened to the upper section of the post 1 by the same rivets 17 and 18 which secure the lever 12.

Welded to the lower section of the post 1, immediately above the ground surface is a flat skirt 4. A pad 5 made of rubber or other resilient waterproof material is glued to the underside of skirt 4 to provide a waterproof seal between the skirt 4 and the flanged area 6 of the receptacle 2 when the post 1 is in place.

It will be apparent to those skilled in the mechanical art that variations may be made in the details of construction and application without departing from the spirit and scope of this invention as defined in the pending claims.

What is claimed is

1. A temporary barrier which comprises a ground imbedded tubular receptacle;
   - a tubular post insertable into the receptacle, having an aperture in its middle section;
   - a flexible lever fastened to the inside upper wall of the post having its lower end bent to form a bolt extending past the lower edges of the post and of the receptacle;
   - means for fastening the lever to the post;
   - means insertable into said aperture for pushing the lever away from the wall; a metal block permanently secured over said aperture having a horizontal channel in line with said aperture intercepted by a vertical channel; and
   - a padlock insertable into said vertical channel.

2. The temporary barrier claimed in 1 wherein said means for pushing comprises a pin having a end forming a closed loop.

3. The temporary barrier claimed in 1 wherein said means for pushing comprises the open end of the padlock loop.

* * * * *